US005918881A

United States Patent [19]

Kirby

[11] Patent Number: 5,918,881

[45] Date of Patent: Jul. 6, 1999

[54] PARTICIPANT SELECTION VIA POLYHEDRON ARROW-INDICIA DISPLAY

[76] Inventor: Matthew A. Kirby, 12503 Sundance Ave., San Diego, Calif. 92129

[21] Appl. No.: 08/939,071

[22] Filed: Sep. 29, 1997

[51] Int. Cl.[6] ..... A63F 9/04

[52] U.S. Cl. ..... 273/146

[58] Field of Search ..... 273/146, 243, 273/242, 248–255, 260, 262

[56] References Cited

U.S. PATENT DOCUMENTS

| | | | |
|---|---|---|---|
| 1,563,680 | 12/1925 | Zwirner | 273/146 |
| 3,195,895 | 7/1965 | Kropinsky | 273/146 |
| 3,208,754 | 9/1965 | Sieve | 273/146 |
| 3,642,286 | 2/1972 | Moore | 273/260 |
| 3,709,498 | 1/1973 | Liston | 273/248 |
| 4,436,306 | 3/1984 | Sanders | 273/146 |
| 4,813,678 | 3/1989 | Collazo et al. | 273/243 |
| 5,342,059 | 8/1994 | Briem | 273/277 |
| 5,511,782 | 4/1996 | Maley | 273/93 R |
| 5,566,096 | 10/1996 | Eardley | 273/146 |

FOREIGN PATENT DOCUMENTS

| | | | |
|---|---|---|---|
| 1187095 | 4/1970 | United Kingdom | 273/146 |

OTHER PUBLICATIONS

PTO/Disclosure Document: (Copy Attached) Serial–NR.: #416,725; Filed: Mar. 24, 1997.

*Primary Examiner*—Benjamin H. Layno

*Attorney, Agent, or Firm*—Inventech/USA

[57] ABSTRACT

The invention sets forth an improved procedure and facile supporting apparatus, enabling players in a game for example, to make unbias determination by sole virtue of chanch, (as a random pointer-device employed in place of a traditional spinner), as to whom shall be the player selected for virtually any imaginable purpose. The apparatus is a platonic-solid,—that is, having equal faces, equal vertices, equal dihedral-angles between the faces. This regular polyhedron, can be any type of 3-dimensional shape having six or more equally shaped preferably planar facets; such as for example a sextahedron(6-sides), an octahedron(8-sides), a decahedron(10-sides), a icosahedron (20-sides); —yet most preferably, a dodecahedron(12-sides) owing to it's compromise of fascet transitions causing the die to roll sufficiently as to be uncontrollable (versus a tetrahedron, which equilateral 4-sides really don't want to tumble-roll much at all), yet not so close to a sphere as a tricontahedron which tends to roll on excessively. The notion being to provide arrow-indicia upon the different facets which are arranged in various directions, whereby the aiming of the arrow unpredictably arriving at the apex-facet, or mesa, when the die stops tumbling determines who the selected player is.

20 Claims, 1 Drawing Sheet

FIG.-1A
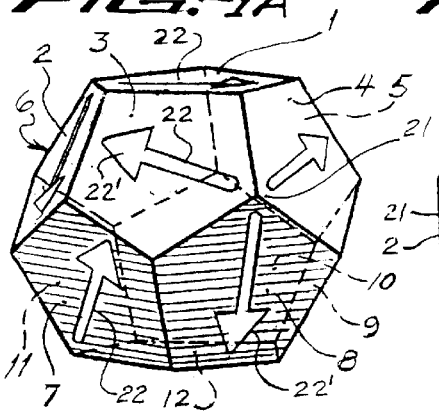
FIG.-1B
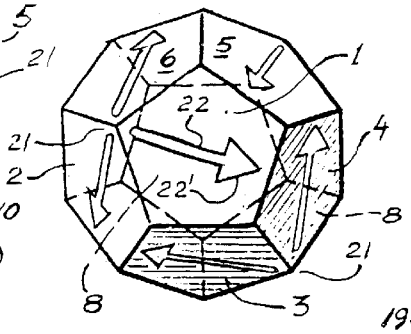
FIG.-1C
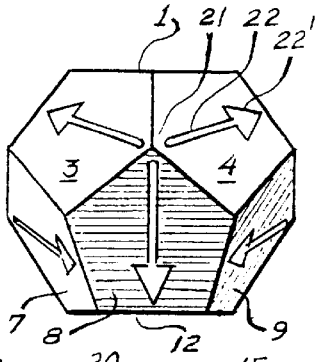
FIG.-2
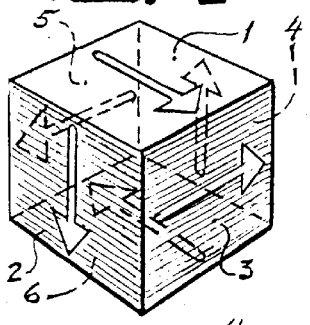
FIG.-3A
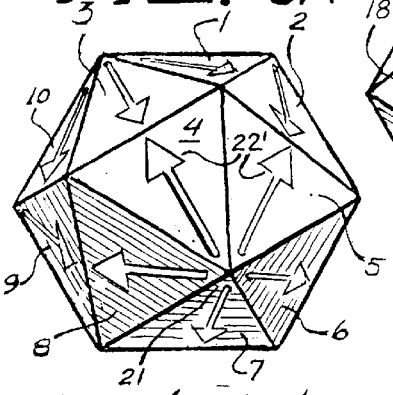
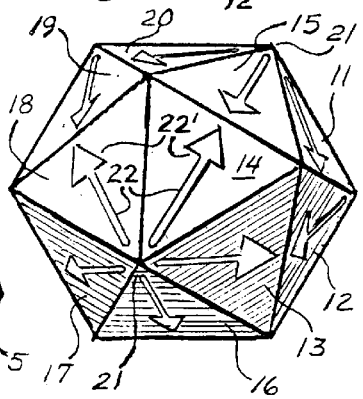
FIG.-3B
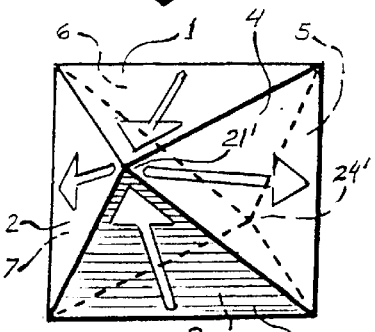
FIG.-4A
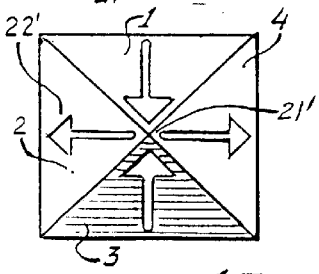
FIG.-4B
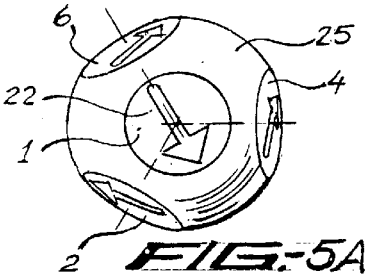
FIG.-5A
FIG.-5B
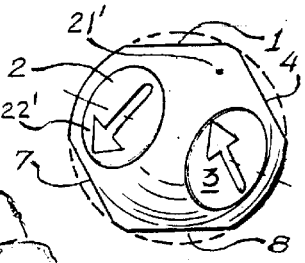
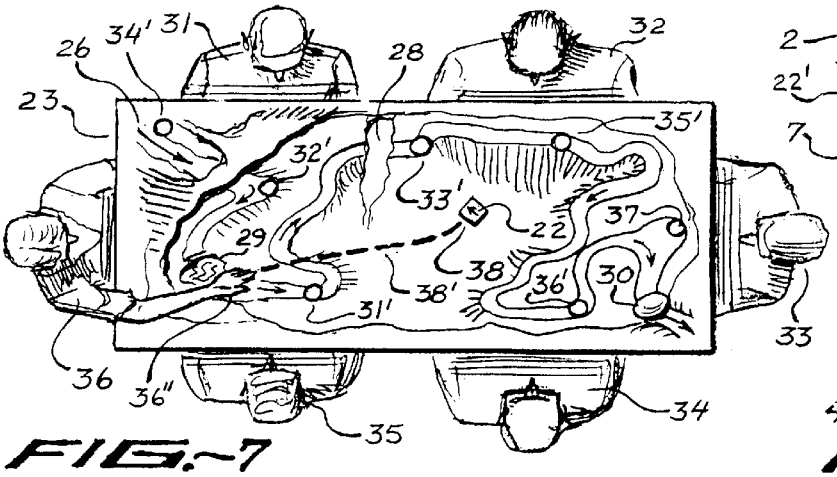
FIG.-7
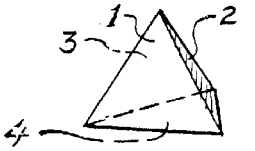
FIG.-6

PARTICIPANT SELECTION VIA POLYHEDRON ARROW-INDICIA DISPLAY

I.) BACKGROUND OF RELEVANT EARLIER INVENTIONS

1. Field of the Invention

This invention relates to 3-dimensional multi-faceted generally thermoplastic-solid constant-density "dice" devices generally bearing a one-to-six dot matrix or other numbered scoring indicia, having been historically employed for a millennium now as an unbiased means by which to, for example in pairs, throw a combination of random indicia for points, or perhaps singly as to simply determine the number of moves in a game; and more specifically, it relates to those types of die exhibiting a horizontal top surface upon landing from a tumbling throw.

2. Related Prior-Art

Background research discovery provides some prior patent-art regarded as germane to this disclosure, chronologically for example in French Pat.#686,287(issued: July 1930) the inventor set forth a rounded die configured with some thrity-eight concave-facets which geo-mathematically cannot possibly be evenly distributed; hence, the throw of such a die would result in an unwanted built-in bias toward some manner of probability.

In U.S. Pat. No. 3,195,895(filed: September 1962) is shown a special pair of dice for a word-game, one bearing letters of the alphabet, the other bearing numbers. The lettered die comprises twenty-six facets upon which faces are displayed a different character of the alphabet; which geometrically results in some faces being square shaped, the others being equilateral-triangle shaped. The numbered die can have six to twenty-six facets, but only bearing number characters 1–9 or 10. There is no anticipation of utilizing the dice as a manner of visual pointer toward a player.

In U.S. Pat. No. 3,208,754(filed: February 1963) is shown a plurality of differently shaped dice preferably selected from a group including a cube (6-facets or sides), an octahedron (8-facets), a dodecahedron (12-facets), an icosahedron (20-facets), and necessarily including a tetrahedron (4-facets); however, the dice facets are here again used only to exhibit number indicia, and as such do not contemplate use as a visual pointer toward a player.

In U.S. Pat. No. 3,655,197(filed: August 1970) is shown a hollow sphere having two concentric spheres, including a viewing-port whereby the internal spheres become positioned as to reveal a number; but as such do not anticipate use as a visual pointer toward a player.

In U.S. Pat. No. 4,345,761(filed: July 1981) is shown a tetrahedral gaming die having recessed equilateral pyramidal facets bearing alphabet-letter indicia; and as such do not anticipate use as a visual pointer toward a player. However, it is further determined that since there is no facet of the die presenting an upwardly facing planar surface horizontal to the playing surface upon which the die rests, then it is unadaptable to the purposes to be later set forth herein.

In U.S. Pat. No. 4,436,306(filed: May 1981) is shown an octahedral dice bearing indicia corresponding as equivalent or tantamount to the analogous ranks of indicia appearing upon playing-cards. The eight numeral bearing facets presented in this device (essentially two equilateral pyramids joined at their base) pose a rather lopsided appearing albeit symmetrical geometric solid, which is considered of a lesser preference as a throwing die for the purposes of this disclosure to be soon revealed.

In U.S. Pat. No. D-283,632(filed: May 1983) is shown a decahedron (10-faceted) game die bearing either numerals or dot matrix indicia, featuring a novel non-flat slightly warped facet of common formation; considered of a lesser preference as a throwing die for the purposes of this disclosure soon to be revealed. Note that with ten-facet sides, their 3-dimensional geometric-form is such that their shape having five-facets arranged upon a single-axis in common with an opposing array of five-facets, thereby creating an undesirable bias in the case of employing arrow-indicia.

In U.S. Pat. No. 4,989,874(field: September 1989) is shown a special lottery selecting ten-faceted die substantially defining two equilateral pyramids joined at their bases, while the two opposed apexes are either leveled or made sufficiently convex as to prevent the die from settling upon that bottom facet. Hence, the die is considered of a lesser preference as an even-handed throwing die for the purposes of this disclosure soon to be revealed.

In U.S. Pat. No. 4,989,875(filed: January 1989) is shown a special eight-faceted die combined with six interspersed convex intersecting surfaces. The facets are decorated with the graphic representations of symbols or suits associated with a deck of playing-cards. The notion here being to enable the user to throw plural dice by which to obtain equivalents of any poker-hand. While this die is a basic octahedron, which is normally considered according to preceding U.S. Pat. No. 4,436,306, the inventor has modified the shape to eliminate the sharp apex points with a more gently tumbling action during a user's throw; hence, it is believed that this configuration could be suitably adopted to the purpose of this disclosure soon to be revealed.

In U.S. Pat. No. 5,342,059(filed: September 1983) is shown a pair of twelve-faceted duodecahedron regular polyhedrons, upon the faces of which is inscribed a perspective rendition of a bowling-alley tapering off into infinity toward one of the apex facets of the die. The graphic representation indicated thereon bore no contemplation nor anticipation as to any use as a functional pointer device since to eliminate the choice of graphic design shown thereon from the tapering wedge ornamentation woud not effect the claimed function of the invention, as shall be subsequently set forth herein.

In U.S. Pat. No. 5,385,473(filed: November 1993) is shown a probability demonstration device in the form of a conventional graphic-projector, and twelve-faceted polyhedral; the polyhedral having graphic dot-matrix patterns arranged thereon, whereby each so marked facet surface is located opposite a blank facet face. Again, no anticipation nor contemplation of it's use as a functional pointer.

In U.S. Pat. No. 5,511,782(filed: April 1996) is shown a so-called therein "octagonal" (believed misnomer) eight-faceted semi-polyhedral kickball for use in a kind of gymnasium "play baseball game" procedure. The kickball's circular facets are very nearly touching in tangency. Again, no contemplation as to use as a pointer-selector is shown.

In U.S. Pat. No. 5,556,096(filed: September 1996 from U.K.) is shown two different dice which are semi-circular polyhedrons, having more facets than a six-sided cuboid shape, yet entirely balanced in the geometric-mathematical sense. The most preferred embodiment shown features thirteen axially opposed facets, or a total of twenty-six facets, each of which bare alpha-numeric indicia only, with no relevance to the notion of serving a pointer/selection function.

Therefore, in full consideration of the preceding patent review, there is determined a need for an improved form of device to which these patents have been largely addressed. The instant inventor hereof believes their newly improved random pointer-selector device, commercially referred to as the ARROdie™, currently being developed for production under auspices of the M.A.Kirby-Mfg./Mkt.Co., exhibits certain advantages as shall be revealed in the subsequent portion of this instant disclosure.

II.) SUMMARY OF THE INVENTION

A.) In view of the foregoing discussion about the earlier invention art, it is therefore important to make it pellucid to others interested in the art that the object of this invention is primarily to provide a simple inexpensive device (having no separate parts or assembly), by which to make an unbias random selective determination in a game, as to selecting from a group of players stationed around a table. Presently, it is known among craps gamblers for example, that a typical cubical-dice (6-sided or 6-faceted) of the type having dimpled indicia (from one to six dot-dimples) has a marked propensity toward landing with the six-dots facing upward, owing that directly opposite the six-dimpled facet is the one-dimpled facet, thereby creating an inherent propensity (especially when thrown against an upright surface, tossed upon a hard surface, or otherwise tumbled perfusely) to naturally land with the slightly heavier side facing down toward action of gravity. Therefore, professional dice are not dimpled, and bare the indicia imprinted upon the surface of the die's facets only; and likewise, one object of this invention to provide a quality die device which throw is not affected (biased) by force of gravity.

For example, in currently popular "role-playing" parlor-games such as DUNGENS & DRAGONS® my ARROdie™ dice(or die) device may be uniquely employed to select one of a group of individual players represented by figurines, to have something happen to them,—such as falling through a trap-door, being struck by a bolder, or being attacked by a vicious monster-figurine. The roll-playing implementation is position dependent;—that is, it is desired to have a device capable of pointing proximally at a literal representation of a character figurine on the playing-board. The graphic-design upon the game-board may appear as a plan-view of a cave for example, with each actual player(live) in the game positioning their personal roll-playing character(figurine) on the floor-plan of the cave prior to a throw of the dice hereof. Hence, for purposes of the instant invention hereof, it is regarded that the throwing of the ARROdie™ upon the game-board to land and point proximally toward a figurine substituting for the actual live person player, is tantamount to pointing toward the live person player. In this optional somewhat virtual-reality manner of imaginative-play substitution, the live person players can thereby be made to introspectively feel they are in fact that very same figurine character appearing upon the game-board.

B.) Another object of this invention disclosure is to set forth a regular polyhedron die apparatus in the form of a perfect geometric polyhedron, preferably a dodecahedron (12-faceted), by which to make unbias random selection when thrown by a person as to land in a final resting position. The plural faceted symmetrical sides thereof being inscribed with indicia shaped in the likeness of an arrow or arrow-head like pointer, each such pointer being preferably arranged upon said facets in a manner of orientation relative to it's neighboring facet surface as to thereby constitute a random visual selection format, facilitating selection of one player individual from a plurality of player individuals grouped around the die device.

As with any quality dice, it is important that the die be made (generally injection-molded) of a durable, and perhaps transparent (as to reveal there being no weighted-implant nor air-bubble which could bias the throw from a random occurance) plastic-resin. Additionally, it is necessary that the geometric configuration of the die be divisive in geometric symmetry relative to each of the faceted sides, each facet being of equal shape and surface area; plus, the die is so geometrically configured that each of the facets share a plane exactly parallel with a facet arranged upon the opposite side of the die; thereby providing a die in which the uppermost facet is always parallel with the landing surface. Since one of the facets must herein serve as the reference-facet, it has been determined that the best reference point is the uppermost landing facet; hence, the top facet is necessarily horizontal or parallel to the landing surface, so that all observers may be caused to instantly recognize just which facet bares the determining indicia. Also, it is important that both the opposed apexes of convergently adjoining plural facets, share a common axis passing through the geometric diametrical center of the die; hence, defining a regular 3-dimensional polyhedron, otherwise referred to as a platonic-solid of six or more facet sides.

C.) Another object of this invention disclosure is to set forth a die apparatus in the form of a regular geometric polyhedron, preferably a dodecahedron(12-sided), wherein the pointer orientation is arranged in one of the following optional generic-variant manner of graphic format: a.) the pointers being preferably arranged in opposite directions upon any two said diametrically opposed facets; b.) the pointers being preferably arranged from the geometric apex of any given facet symmetrically toward the opposite linear-edge of the same facet surface; c.) the pointers being preferably arranged from the proximal linear-edge of any given facet symmetrically toward the opposite geometric apex of the same facet surface; d.) in a regular sextahedron cubic polyhedron (6-sided), the pointers being preferably arranged from a proximal linear-edge of any given facet symmetrically toward the opposite geometric linear-edge of the same facet surface; or, the pointers being arranged from a proximal apex of any given facet toward the symmetrically opposite apex formation of the same facet surface; e.) and in a regular dodecahedron(12-sided) specifically, a graphic format arrangement whereby the pointers preferably emanate from a common apex adjoining three pentagonal-shaped facets, no such three adjoining pentagonal-shaped faceted group of pointers sharing a geometric-axis in common with any other like three groups exhibiting three adjoining pentagonal-shaped facets. However, it is incumbent that virtually any directional arrangement of arrow-indicia be considered acceptable, even if not entirely geographically symmetrical, in so long as the facets are regular.

D.) Another object of the invention disclosure is to set forth an novel die device having a basic spherical configuration upon which surface is made eight equally spaced apart circular facets; each such facet thus corresponding the flat plane surfaces representative of a pure regular octahedron (8-sided). The advantage of the "semi-spherical octahedron" residing in it's tendency to roll easier upon a given amount of throw, as compared to a traditional octahedron. Note also, that in any regular die configuration of this disclosure, it is generally preferably that the physical size of the die be made to a scale relative to the average human-hand which would enable the die to be thoroughly tumbled within the cupped-close hand prior to released-through of the die;—thereby better assuring the attaining of a purely random landing result.

III.) DESCRIPTION OF THE PREFERRED EMBODIMENT DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the Claims section annexed hereto; and accordingly, a better understanding of the invention and the variant uses is intended, by reference to the drawings, which are considered as primarily exemplary and not to be therefore construed as restrictive in nature; wherein:

FIG. 1A, is a 10-degree upward perspective-view favoring the upper facets of the preferred regular dodecahedron (12-sided) embodiment, wherein the six hidden opposite facet portions are shown in phantom-outline, and including my preferred arrow-indicia orientations thereto;

FIG. 1B, is a top/plan-view thereof, wherein the bottom-plan facet portions are also revealed in phantom-outline, and including my preferred arrow-indicia orientations thereto;

FIG. 1C, is a side/elevation-view thereof, and including my preferred graphic format layout of the arrow-indicia orientations thereto;

FIG. 2, is a 45-degree upper/perspective-view of a regular cubic(6-sided or sextahedron) die remiss of usual dot-matrix graphic format, wherein the three hidden opposite facets are shown via phantom-outline, and including my preferred arrow-indicia orientations thereto;

FIG. 3A, is a 30-degree upper/perspective-view of a regular icosahedron(20-sided) embodiment, wherein the ten hidden opposite facet portions do not appear in phantom-outline, and, including my preferred arrow-indicia orientations thereto;

FIG. 3B, is an exact 180-degree opposite-side view thereof, showing the other ten facets thereof, and, including my preferred arrow-indicia orientations thereto;

FIG. 4A, is a 45-degree upward perspective-view thereof, and, including my preferred arrow-indicia orientations thereto, wherein the four hidden opposite facet portions are shown via phantom-outline;

FIG. 4B, is an axial-end view of a regular octahedron(8-sided) embodiment, and, including my preferred arrow-indicia orientations thereto;

FIG. 5A, is a top/plan-view showing my semi-circular regular octahedron(8-sided), and, including my preferred arrow-indicia orientations thereto;

FIG. 5B, is a side/elevation-view thereof, and, including my preferred arrow-indicia orientations thereto;

FIG. 6, is represented the less desirable tetrahedron (4-sided) polyhedron, in a 30-degree upper/perspective-view thereof, wherein the two hidden opposite facet portions are shown via phantom-outline;

FIG. 7, is an upper/plan-view of an exemplified player setting, wherein a die device is shown pointing to a random selected player.

IV.) ITEMIZED NOMENCLATURE REFERENCES

1-20—facets (for side counting reference purposes only)
21/21'—apex convergence of adjoining facets (pure-polyhedron/semi-circular polyhedron)
22,22'—stem of arrow, head of arrow
23—table-top
24/24'—convergent apex-axes (sharp-edged version/semi-circular version)
25—spheroidal surface
26—ascension entry
27—cavern ledges
28—fiery-mote
29—snake-pitfall
30—huge-bolder
31,31'—player, figurine
32,32'—player, figurine
33,33'—player, figurine
34,34'—player, figurine
35,35'—player, figurine
36,36'—player, figurine, die throwing hand
37—monster
38,38'—thrown die, tumbling-roll

V.) DETAILED DESCRIPTION OF THE PREFERRED EMBODIMENTS

Initial reference is given by way of FIGS. 1A/B/C, wherein is exhibited the presently most preferred embodiment of the invention, that being a 12-sided(faceted) regular (meaning all facets are of the same size and same shape) polyhedron technically referred to as dodecahedron. The FIGS. 1A/B/C show how I prefer to arrange the stem portions 22 of my arrow indicas in a cluster such as a triad formation emanating from a common apex axis point 21, in this example employing pentagonal shaped facets; wherein the arrowhead portions 22' preferably point perpendicularly toward the straight edged sides of the different facets numbered here 1–12. The dodecahedron is herein considered the ideal "compromise" polyhedron to serve my novel pointer function, owing that the shape tends to randomly roll out further upon landing from a tumbling throw, as compared to the familar sextahedron of FIG. 2 for example. Yet the fascet surface-area of the 12-sided dodecahedron is significantly greater (as to advantageously present a clearly demarked arrow) than that surface-area of the 20-faceted icosahedron of FIGS. 3A/B.

While the relative surface-area of the equilateral-triangles forming the octahedron (8-sided) of FIGS. 4A/B are even more generous, the pure octahedron unfortunately lacks a good propensity toward a tumbling-roll, owing to the transitional severity of it's interconnecting angles. However, the generic-variant octahedron of FIGS. 5A/B overcomes this inherent resistance toward a tumbling-roll, owing that it is of semi-circular configuration; hence, the severity of angularity or pitch transitions between it's facets 1–8 is effectively ameliorated via the combined spheroidal shape arranged between the eight-facets. Also shown in FIG. 5B is ref.-dot 21' representing the axes-point equivalent to the convergence point 21 shown in FIGS. 4A/B. And note, that the diameter of the resultantly circular facets 1–8 can actually be made substantially greater than that exhibited in FIGS. 5A/B, when the facets are made tangent, that is, proximally touching each other;—the configuration as shown being a compromise between a further tumbling-roll and facet surface-area. While the notion of likewise making a polyhedral dodecahedron(12-sided) type pointer-die per FIGS. 1A/B/C of likewise semi-circular configuration, is also novel; the most marked improvment in tumbling-roll action is to be gained between the octahedron(8-faceted) examples of FIGS. 4A/B & 5A/B. For complete understanding, the tetrahedron(4-sided) of FIG. 6 is included here only as an example of an unadaptable polyhedron shape, owing that no horizontal-facet "mesa" is provided at the apex of the platonic-solid;—the mesa (see 1 of FIG. 1C & FIG. 5B) being a vital characteristic, considered a necessarily inherent feature of my pointer-indicator die invention.

Finally, by way of demonstrating one manner in which my new pointer-indicator die device may be implemented,—in FIG. 7 is shown a plan-view of an ordinary table-top 23 upon which is arranged an exemplified layout of the well known DUNGENS & DRAGONS® game, wherein an imaginative (usually two-dimensional) graphic representation of a cave is shown. This fantasy representation might include an ascension staging-area 26 into an earthen-cavern, replete with precarious ledges 27, fiery-mote 28, snake-pitfall 29, and a huge-bolder 30 blocking the exit for example. While also shown, are six different miniature "player-character" action figurines—31', 32', 33', 34', 35', 36' (corresponding to their actual live-player counterparts—31, 32, 33, 34, 35, 36 ). Plus, a miniature dragon or other formidable "monster" 37 is usually included to make things even more challenging for the to players. Note here, instead of employing a conventional spinner type pointer to determine a player, that player 36 at far left is shown having in turn just hand 36" thrown my special arrow bearing pointer-indicator die (here exemplified as a cubic or sextahedron) which is shown having tumbled 38' and landed to a stop 38; and hence, wherein the topmost arrow-indicia 22 is randomly, and actually, pointing toward figurine 33' (but virtually corresponding to live-player 33). Alternately, some players may prefer to simply go by an alternate rule that indicator-die 38 is to actually point at the live-player, rather than follow the procedure whereby the indicator-die 38 points to a live-player's sublimating character (such as 33') on the game-surface platform. In any case, if the die's arrow-indicia 22 lands pointing indeterminantely (disputably so) between a pair of players, the next character going clockwise is the one; or, the die is simply rethrown until there is no dispute whom is selected.

Thus, it is readily understood how the preferred and generic-variant embodiments of this invention contemplate performing functions in a novel way not heretofore available nor realized. It is implicit that the utility of the foregoing adaptations of this invention are not necessarily dependent upon any prevailing invention patent; and, while the present invention has been well described hereinbefore by way of certain illustrated embodiments, it is to be expected that various changes, alterations, rearrangements, and obvious modifications may be resorted to by those skilled in the art to which it relates, without substantially departing from the implied spirit and scope of the instant invention. Therefore, the invention has been disclosed herein by way of example, and not as imposed limitation, while the appended Claims set out the scope of the invention sought, and are to be construed as broadly as the terminology therein employed permits, reckoning that the invention verily comprehends every use of which it is susceptible. Accordingly, the embodiments of the invention in which an exclusive property or proprietary privilege is claimed, are defined as follows.

What is claimed of proprietary inventive origin is:

1. A device by which to make unbias selective determination of a player in a game; said device comprising:

a die of constant density having a plurality of facets, each said facet being a side of equal shape and size;

a said die configured so each said facet shares plane in parallel with a facet arranged upon the opposite side of said die;

said die configured so that an axis passes simultaneously through both the opposed apexes convergent of plural said facets and through the geometric diametrical center of said die;

each facet consisting of only one indicia, said indicia on each facet being shaped in the likeness of a single arrow or of only a single arrow-head like pointer, said single arrow or said single arrow-head like portion including pointer orientation means relative to neighboring said facets as to thereby facilitate a random visual selection of an individual from a plurality of players grouped around said die.

2. The random selection device according to claim 1, wherein said pointer orientation means is arranged in opposite directions upon any two said diametrically opposed facets.

3. The random selection device according to claim 1, wherein said pointer orientation means is arranged from the geometric apex of any given facet proximally toward the opposite linear-edge of same said facet.

4. The random selection device according to claim 1, wherein said pointer orientation is arranged from the proximal linear-edge of any given facet toward the opposite geometric apex of same said facet.

5. The random selection device according to claim 1, wherein said pointer orientation means is arranged from a proximal linear-edge of any given said facet toward the opposite geometric linear-edge of same said facet.

6. The random selection device according to claim 1, wherein said die is a regular sextahedron.

7. The random selection device according to claim 1, wherein said die is a regular octahedron.

8. The random selection device according to claim 7, wherein said octahedron is formed as a semi-spherical shape having eight equally spaced apart circular facets thereon.

9. The random selection device according to claim 1, wherein said die is a regular dodecahedron.

10. The random selection device according to claim 1, wherein said die is a regular icosahedron.

11. A one-piece apparatus by which to make unbias random selection when thrown to rest; said apparatus comprising:

a die of constant density having a plurality of twelve facets, each said facet being of equal size and shape;

said die configured so each said facet shares a plane in parallel with a facet arranged upon the opposite side of said die;

each facet consisting of only one indicia, said indicia on each facet being shaped in the likeness of only a single arrow or only a single like pointer, said single arrow or said single arrow-head like pointer including a pointer orientation means relative to neighboring said facets as to thereby facilitate a random visual selection from a plurality of individuals or icons.

12. The random selection device according to claim 11, wherein said twelve-sided die is a regular dodecahedron, wherein said facets are pentagonally shaped.

13. The random selection device according to claim 11, wherein said twelve-sided die is a semi-circular dodecahedron, wherein said facets are circular.

14. A method by which to make unbias selective determination of a player in a game, by throwing of a die device; said method comprising the steps of:

providing a die having a constant density and including a plurality of facets of regular size and shape;

said die configured so each said facet shares a plane in parallel with a facet arranged upon the opposite side of said die, and said die including an axis passing simultaneously through both the opposed apexes convergent of plural said facets and through the geometric diametrical center of said die;

each facet consisting of only one indicia, said indicia on each facet being shaped in the likeness of only a single arrow or of only a single arrow-head like pointer, said single arrow or said single arrow-head like pointer including a pointer orientation means relative to neighboring said facets;

providing a playing surface for throwing said die thereon;

grouping a plurality of players around the perimeter of said playing surface;

throwing said die onto said playing surface, wherein the die rolls and comes to rest on the playing surface, the die resting with a topmost facet face-up;

randomly selecting one of said players by visually observing the direction of the pointer orientation means on said topmost facet.

15. The random selection method according to claim 14, wherein said die device configuration can be one selected from a class grouping of regular polyhedrons including a sextahedron, an octahedron, a dodecahedron, or an icosahedron.

16. The random selection method according to claim 14, wherein said pointer orientation means is arranged in opposite directions upon any two said diametrically opposed facets.

17. The random selection method according to claim 14, wherein said pointer orientation means is arranged from the geometric apex of any given facet proximally toward the opposite linear-edge of same said facet.

18. The random selection method according to claim 14, wherein said pointer orientation means is arranged from the proximal linear-edge of any given facet toward the opposite geometric apex of same said facet.

19. The random selection method according to claim 14, wherein said pointer orientation means is arranged from the proximal linear-edge of any given facet toward the opposite geometric linear-edge of same said facet.

20. The random selection method according to claim 14, wherein each said player is an icon figurine representing an actual living player for purposes of imaginative-play substitution, thereby enabling the respective live players to introspectively feel as though they are their figurine character appearing upon the game-board as a manner of virtual-reality.

* * * * *